US007036495B1

(12) United States Patent
Shimizu

(10) Patent No.: US 7,036,495 B1
(45) Date of Patent: May 2, 2006

(54) IGNITION DEVICE FOR INTERNAL COMBUSTION ENGINE

(75) Inventor: Takeshi Shimizu, Tokyo (JP)

(73) Assignee: Mitusbishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/147,229

(22) Filed: Jun. 8, 2005

(30) Foreign Application Priority Data

Mar. 23, 2005 (JP) ..... 2005-083641

(51) Int. Cl.
*F02P 15/00* (2006.01)

(52) U.S. Cl. ..... 123/633; 123/260; 123/634

(58) Field of Classification Search ..... 123/260, 123/630, 632, 633, 634, 635, 143 B
See application file for complete search history.

(56) References Cited

U.S. PATENT DOCUMENTS 5,590,637 A * 1/1997 Motodate ..... 123/634
6,378,514 B1 * 4/2002 Kaminaga et al. ..... 123/633
6,883,490 B1 * 4/2005 Jayne ..... 123/260

FOREIGN PATENT DOCUMENTS

JP 2004-232466 A 8/2004

* cited by examiner

*Primary Examiner*—Willis R. Wolfe
*Assistant Examiner*—Johnny H. Hoang
(74) *Attorney, Agent, or Firm*—Sughrue Mion, PLLC

(57) ABSTRACT

Provided is an ignition device for an internal combustion engine which prevents a crack from being produced in a cast insulating resin, and a noise-suppressing resistor from being damaged. An ignition device for an internal combustion engine according to the present invention includes a case (3), a cast insulating resin (4), a high-voltage connection terminal (7), and a noise-suppressing resistor (8). The case (3) is composed of a case body (3*a*) receiving a transformer (2) and a high-voltage tower (3*b*) having an opening portion (5), and the case body (3*a*) and the high-voltage tower (3*b*) communicate with each other through the opening portion (5). The cast insulating resin (4) is injected into the case body (3*a*) and cured, thus insulating and fixing the transformer (2). The high-voltage connection terminal (7) closes the opening portion (5) such that the cast insulating resin (4) that has not been cured is prevented from entering the high-voltage tower (3*b*). The noise-suppressing resistor (8) is arranged in the high-voltage tower (3*b*), is electrically connected to the high-voltage connection terminal (7), and suppresses noise generated by a discharge of the spark plug (9).

7 Claims, 4 Drawing Sheets

IGNITION DEVICE FOR INTERNAL COMBUSTION ENGINE

BACKGROUND OF THE INVENTION

1. Field of the Invention

The present invention relates to an ignition device for an internal combustion engine provided with a noise-suppressing resistor for suppressing noise generated at the time of a discharge of an spark plug disposed in a high-voltage tower.

2. Description of Related Art

Conventionally, in an ignition device for an internal combustion engine disclosed, for example, in JP 2004-232466 A (FIG. 1, paragraph 0011), a noise-suppressing resistor 8 disposed in a high-pressure cylinder 7 is connected at one end thereof to a high-voltage terminal 6 and at the other end thereof to a coil spring 23 which is electrically connected to an apex terminal 33 of an spark plug 32. A cast insulating resin 5, which is injected into a case 4 so as to insulate and fix a transformer, is cured, whereby the noise-suppressing resistor 8 is held electrically connected to the high-voltage terminal 6 in the high-pressure cylinder 7.

The noise-suppressing resistor 8 is, generally, constructed by connecting and fixing electrodes to both ends of a ceramic resistor respectively, and is used for the purpose of preventing electrical noise generated at the time of a spark discharge of the spark plug 32 from affecting peripheral electronic components.

In the aforementioned ignition device for the internal combustion engine, however, the noise-suppressing resistor 8 and the high-voltage terminal 6 are fixed by the cast insulating resin 5 so as to prevent abrasion from being caused between the noise-suppressing resistor 8 and the high-voltage terminal 6 due to, for example, engine vibration. Thus, there have been problems in that a crack is produced in the cast insulating resin 5 as a result of a difference in coefficient of linear expansion arising between the cast insulating resin 5 made of an epoxy resin and the noise-suppressing resistor 8 made of a ceramic, and the noise-suppressing resistor 8 is damaged by a thermal stress ascribable to the cast insulating resin 5.

There has also been a problem in that the noise-suppressing resistor 8 and the high-voltage terminal 6 must be connected to each other in advance of injecting the cast insulating resin 5 into the case 4 with a view to preventing the noise-suppressing resistor 8 and the high-voltage terminal 6 from being brought out of electrical contact with each other due to the interposition of the cast insulating resin 5.

SUMMARY OF THE INVENTION

The present invention has been made to solve the problems as mentioned above, and has an object to provide an ignition device for an internal combustion engine which prevents a crack from being produced in a cast insulating resin or a noise-suppressing resistor from being damaged, and which makes it easy to electrically connect the anti-resistor and the high-voltage output terminal to each other after the cast insulating resin is cured.

An ignition device for an internal combustion engine according to the present invention includes: a transformer that has a primary winding and a secondary winding; a case that is composed of a case body receiving the transformer and a high-voltage tower having an opening portion, the case body and the high-voltage tower communicating with each other through the opening portion; a cast insulating resin that is injected into the case body and cured and thus insulates and fixes the transformer; a high-voltage connection terminal that is connected to one end of the secondary winding, closes the opening portion such that the cast insulating resin that has not been cured is prevented from entering the high-voltage tower; a noise-suppressing resistor that is placed in the high-voltage tower, is electrically connected to the high-voltage connection terminal, and suppresses noise generated at a time of a discharge of an spark plug; and a high-voltage output terminal that is provided in an end portion of the noise-suppressing resistor and outputs a high voltage to the spark plug.

The ignition device for the internal combustion engine according to the present invention prevents a crack from being produced in the cast insulating resin or the noise-suppressing resistor from being damaged, and makes it easy to electrically connect the anti-resistor and the high-voltage output terminal to each other after the cast insulating resin is cured.

DETAILED DESCRIPTION OF PREFERRED EMBODIMENTS

Figure 1:
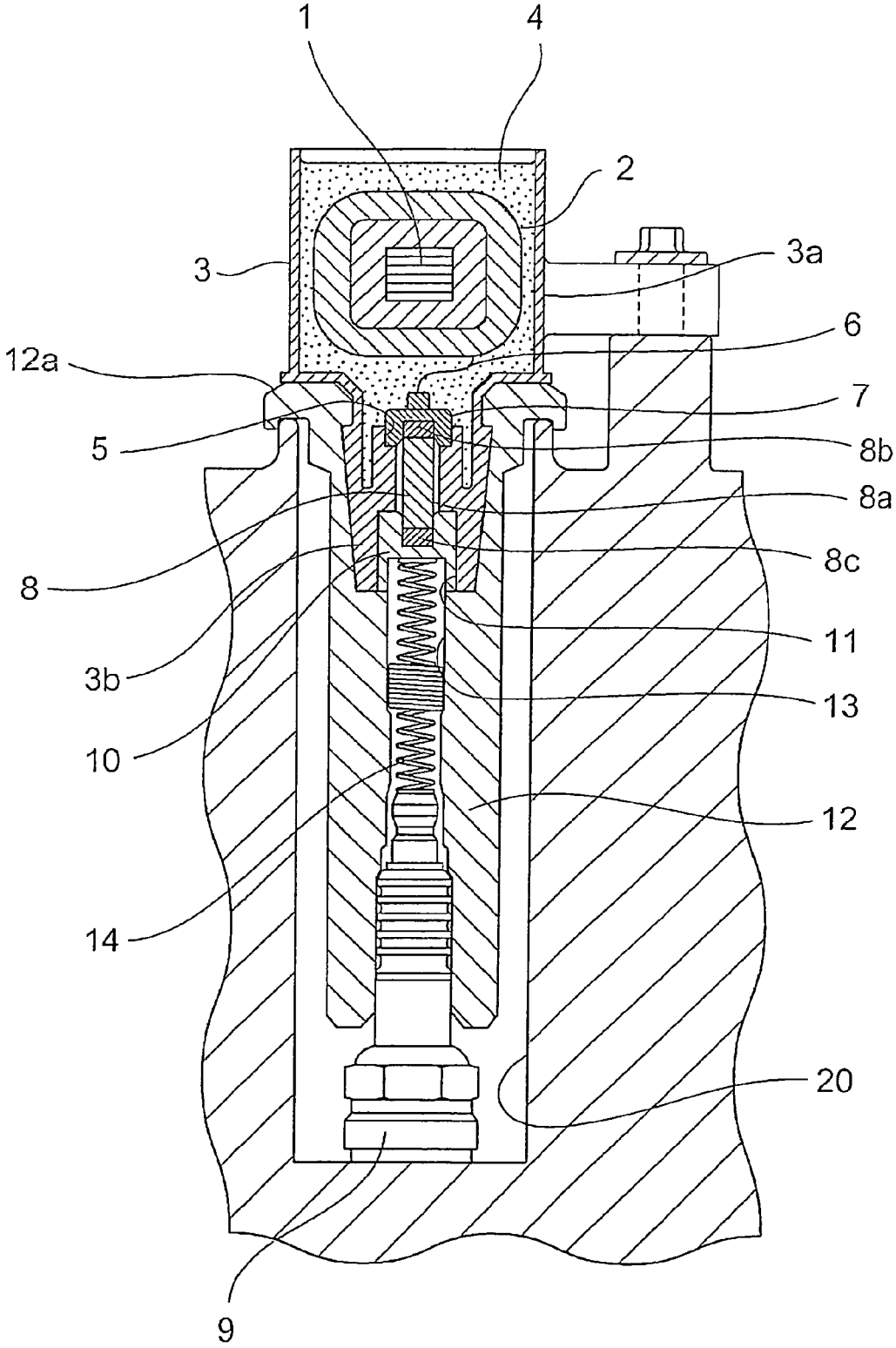
FIG. 1 is a cross-sectional view showing an ignition device for an internal combustion engine according to a first embodiment of the present invention.

Respective embodiments of the present invention will be described hereinafter by referring to the drawings. In the following description, like or equivalent components or portions are denoted by the same reference symbols.

First Embodiment

FIG. 1 is a cross-sectional view showing an ignition device for an internal combustion engine according to a first embodiment of the present invention.

In this ignition device for the internal combustion engine, a transformer 2, which is obtained by winding a primary winding and a secondary winding around a core 1, is disposed in a case 3. The case 3 is composed of a case body 3*a* and a high-voltage tower 3*b*. The case body 3*a* contains the transformer 2 that is insulated and fixed by a cast insulating resin 4. The high-voltage tower 3*b* is formed integrally with the case body 3*a* and has an opening portion 5 communicating with the case body 3*a*.

The opening portion 5 of the high-voltage tower 3*b* is provided with a high-voltage connection terminal 7, which is electrically connected to a connection wire 6 of the secondary winding, in such a manner as to close the opening portion 5. A noise-suppressing resistor 8, which prevents electrical noise ascribable to a spark discharge caused by an spark plug 9 from affecting peripheral electronic components, is arranged inside the high-voltage tower 3*b*. The noise-suppressing resistor 8 is composed of a columnar ceramic body 8*a* and electrodes 8*b* and 8*c* that are provided at both ends of the body 8*a* respectively. The electrode 8*b* of the noise-suppressing resistor 8 is press-fitted in the high-voltage connection terminal 7 which is in the shape of a cylinder with a closed bottom.

A high-voltage output terminal 10 that outputs a high voltage to the spark plug 9 is press-fitted in a depression portion 11 at a tip of the high-voltage tower 3*b*. The electrode 8*c* of the noise-suppressing resistor 8 is press-fitted in the high-voltage output terminal 10 which has an H-shaped cross-section.

A rubber plug boot 12 is fittingly attached to the side of the high-voltage tower 3*b* of the case 3. A through-hole 13 is formed in the plug boot 12 along its central axis. A spring 14 that is electrically connected to the spark plug 9 is provided in the through-hole 13, urging the spark plug 9.

Next, a procedure of manufacturing the ignition device for the internal combustion engine constructed as described above will be described.

First, the high-voltage connection terminal 7 is integrated with the case 3 by insert molding, whereby the opening portion 5 of the high-voltage tower 3*b* is closed.

Then, the transformer 2 is mounted in the case body 3*a*. In this process, the connection line 6 of the transformer 2 is electrically connected to the high-voltage connection terminal 7.

After that, the cast insulating resin 4 as an epoxy resin is injected into the case body 3*a* and cured, so that the transformer 2 is insulated and fixed in the case body 3*a*.

Subsequently, the electrode 8*b* of the noise-suppressing resistor 8 is press-fitted into the high-voltage connection terminal 7 and fixed thereto. Furthermore, the high-voltage output terminal 10 is press-fitted onto the electrode 8*c* of the noise-suppressing resistor 8 from the same direction, whereby the noise-suppressing resistor 8 is fixed to the high-voltage tower 3*b*.

Finally, the plug boot 12 that accommodates the spring 14 is mounted to the high-voltage tower 3*b*.

According to the ignition device for the internal combustion engine in this embodiment, the high-voltage connection terminal 7 closes the opening portion 5 of the high-voltage tower 3*b*. Thus, the cast insulating resin 4 that has not been cured is prevented from entering the high-voltage tower 3*b* during a manufacturing process, and the noise-suppressing resistor 8 is prevented from receiving a thermal stress from the cast insulating resin 4, leading to an increase in reliability.

Further, the noise-suppressing resistor 8 and the high-voltage output terminal 10 are inserted into the high-voltage tower 3*b* in the final stage of the manufacturing process, whereby making it easy to electrically connect the noise-suppressing resistor 8 and the high-voltage output terminal 10. Thus, assembling operation is performed more efficiently in comparison with case of the conventional ignition device that requires electric connection between the noise-suppressing resistor and the high-voltage terminal in advance of casting the insulating resin.

The high-voltage connection terminal 7 and the high-voltage output terminal 10, which are concave in shape, are fittingly attached to the electrodes 8*b* and 8*c* at the ends of the noise-suppressing resistor 8, which is securely held with respect to the high-voltage tower 3*b*. Thus, the noise-suppressing resistor 8 is prevented from being damaged by abrasion generated between the noise-suppressing resistor 8 and the high-voltage output terminal 10 due to, for example, engine vibration.

In comparison with a manufacturing process of an ignition device for an internal combustion engine having no noise-suppressing resistor, only the step of inserting the noise-suppressing resistor 8 and the high-voltage output terminal 10 is added after the cast insulating resin has been injected and cured. Consequently, no substantial change is made terms of in assembling operation.

The high-voltage connection terminal 7 is integrated with the case 3 by insert molding, and the opening portion 5 of the high-voltage tower 3*b* is reliably and easily closed by the high-voltage connection terminal 7.

When the ignition device for the internal combustion engine is mounted to the engine by inserting the plug boot 12 into a plug hole 20, a flange 12*a* of the plug boot 12 is sandwiched between the case body 3*a* and the engine. Thus, the plug boot 12 is prevented from falling off due to engine vibration.

Second Embodiment

Figure 2:
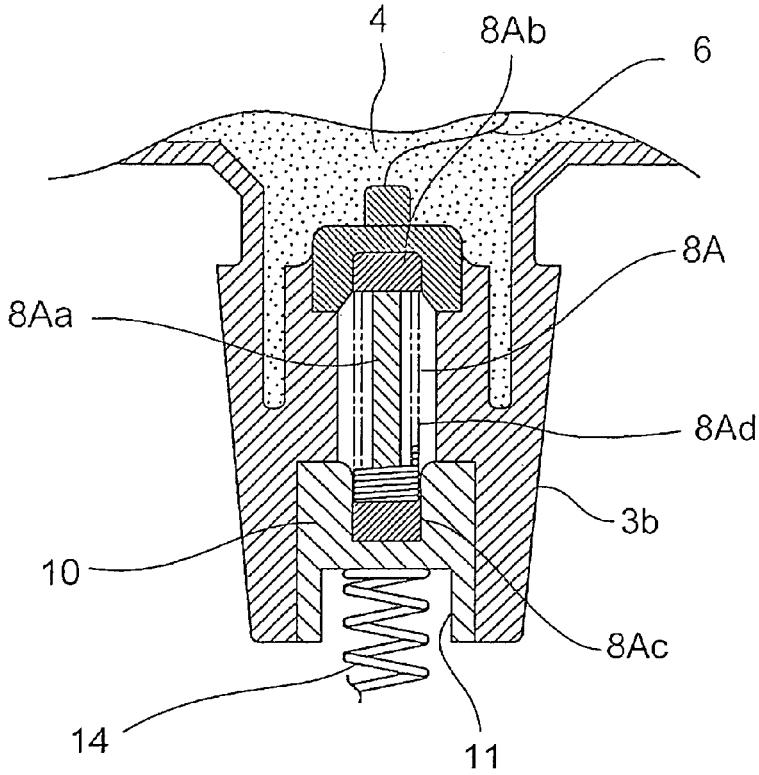
FIG. 2 is a cross-sectional view showing an essential part of an ignition device for an internal combustion engine according to a second embodiment of the present invention.

FIG. 2 is a cross-sectional view showing an essential part of an ignition device for an internal combustion engine according to a second embodiment of the present invention.

In this embodiment, a noise-suppressing resistor 8A is composed of a core rod 8Aa, electrodes 8Ab and 8Ac, and a resistance wire 8Ad. The electrodes 8Ab and 8Ac are provided respectively at both ends of the core rod 8Aa. The resistance wire 8Ad is wound around the core rod 8Aa providing a gap between the resistance wire 8Ad and an inner wall surface of the high-voltage tower 3*b*.

The second embodiment is identical to the first embodiment in terms of other constructional details.

In this embodiment, since the resistance wire 8Ad is wound around the core rod 8Aa, noise in a high frequency range can also be suppressed owing to the effect of inductance.

Further, the resistance wire 8Ad is wound providing a gap between itself and the inner wall surface of the high-voltage tower 3*b*. Thus, the resistance wire 8Ad is prevented from being damaged by being exposed to an external stress, for example, in driving the engine, thereby ensuring reliability.

Third Embodiment

Figure 3:
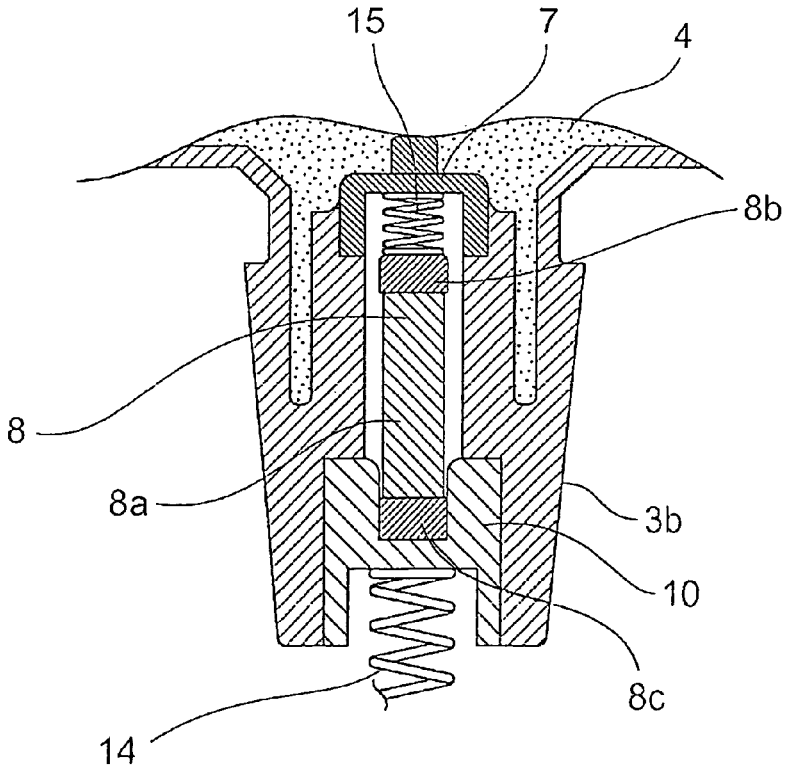
FIG. 3 is a cross-sectional view showing an essential part of an ignition device for an internal combustion engine according to a third embodiment of the present invention.

FIG. 3 is a cross-sectional view showing an essential part of an ignition device for an internal combustion engine according to a third embodiment of the present invention.

This embodiment is different from the first embodiment in that a spring 15, to which an elastic force is applied in such a direction as to move the high-voltage connection terminal 7 and the noise-suppressing resistor 8 away from each other, is provided between the high-voltage connection terminal 7 and the noise-suppressing resistor 8, and the inner diameter of the high-voltage connection terminal 7 is larger than the outer diameter of the electrode 8*b* of the noise-suppressing resistor 8.

In this embodiment, the spring 15, to which an elastic force is applied in such a direction as to move the high-voltage connection terminal 7 and the noise-suppressing resistor 8 away from each other, is provided between the high-voltage connection terminal 7 and the noise-suppressing resistor 8. Therefore, the high-voltage connection terminal 7 and the noise-suppressing resistor 8 are electrically connected to each other with more reliability.

Even when the noise-suppressing resistor 8 is inserted into the high-voltage tower 3*b* under such a state where the high-voltage connection terminal 7 and the high-voltage output terminal 10 are not coaxial with each other, the spring 15 prevents a bending stress from being applied to the noise-suppressing resistor 8, thereby ensuring reliability.

The inner diameter of the high-voltage connection terminal 7 that is in the shape of a cylinder with a closed bottom is larger than the outer diameter of the electrode 8*b* of the noise-suppressing resistor 8, and there is no need to bring an outer peripheral surface of the electrode 8*b* into close contact with the inner wall surface of the high-voltage connection terminal 7. Therefore, high accuracy is not required in terms of dimensional accuracy in processing the inner wall surface of the high-voltage connection terminal 7 and the outer peripheral surface of the electrode 8*b*, which reduces the processing cost.

The high-voltage connection terminal 7 should not necessarily be limited to a shape corresponding to the electrode 8*b*. The high-voltage connection terminal 7 is required only to have functions of closing the opening portion 5 and preventing the cast insulating resin 4 that has not been cured from entering the high-voltage tower 3*b*. Thus, the degree of freedom regarding the shape of the high-voltage connection terminal 7 increases, and it is also possible to select the high-voltage connection terminal 7 having a shape leading to inexpensiveness.

Fourth Embodiment

Figure 4:
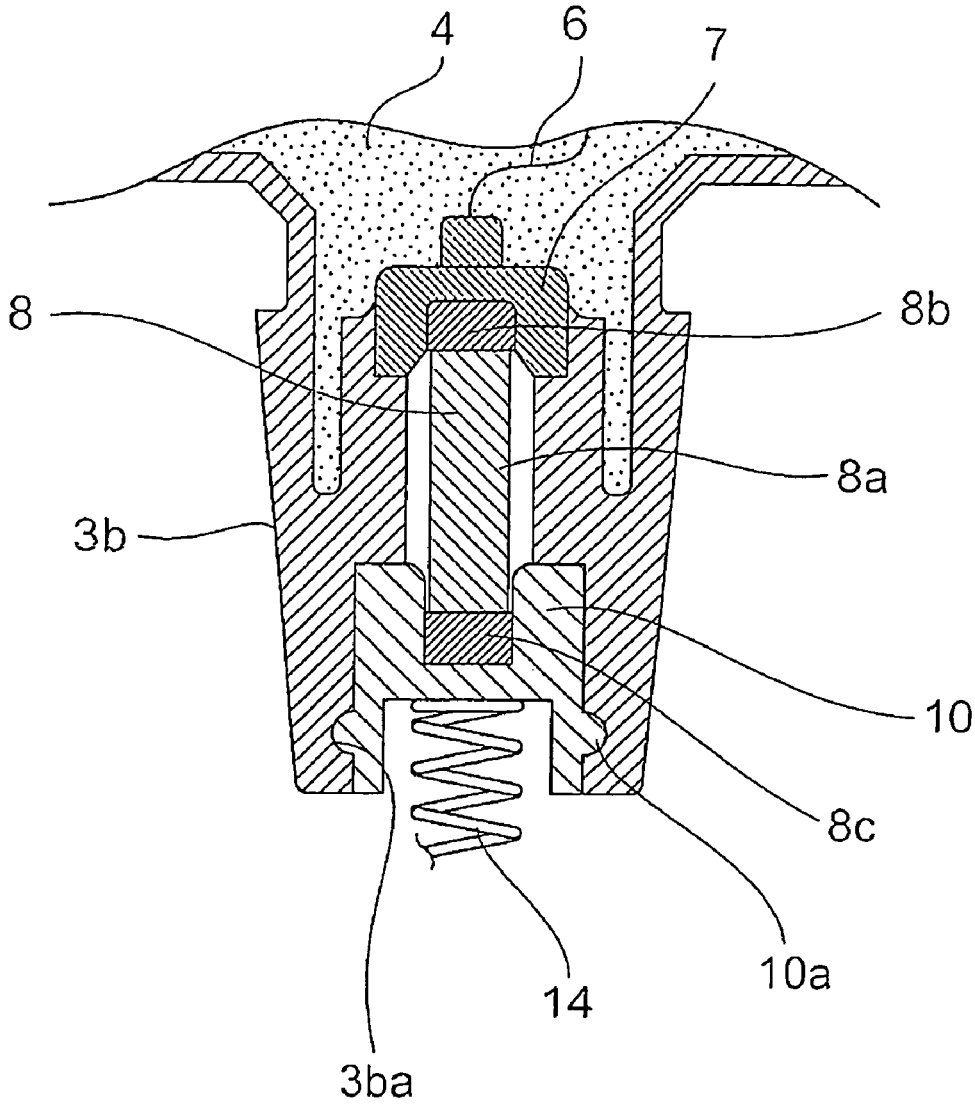
FIG. 4 is a cross-sectional view showing an essential part of an ignition device for an internal combustion engine according to a fourth embodiment of the present invention.

FIG. 4 is a cross-sectional view showing an essential part of an ignition device for an internal combustion engine according to a fourth embodiment of the present invention.

In this embodiment, the high-voltage output terminal 10 is fittingly attached to a tip portion of the high-voltage tower 3*b*. However, this embodiment is different from the first embodiment in that there is an irregular surface formed between the outer peripheral surface of the high-voltage output terminal 10 and the inner wall surface of the high-voltage tower 3*b*.

In this embodiment, a projection portion 10*a* is formed on the outer peripheral surface of the high-voltage output terminal 10, and a depression portion 3*ba* to which the projection portion 10*a* is fittingly attached is formed in the inner wall surface of the high-voltage tower 3*b*. Thus, the high-voltage output terminal 10 is fittingly attached to the high-voltage tower 3*b* more reliably and more firmly. As a result, the high-voltage output terminal 10 can be prevented from being displaced relatively to the high-voltage tower 3*b* due to engine vibration, for example.

It is also appropriate to form a depression portion on the side of the high-voltage output terminal 10 and a projection portion on the side of the high-voltage tower 3*b*.

Fifth Embodiment

Figure 5:
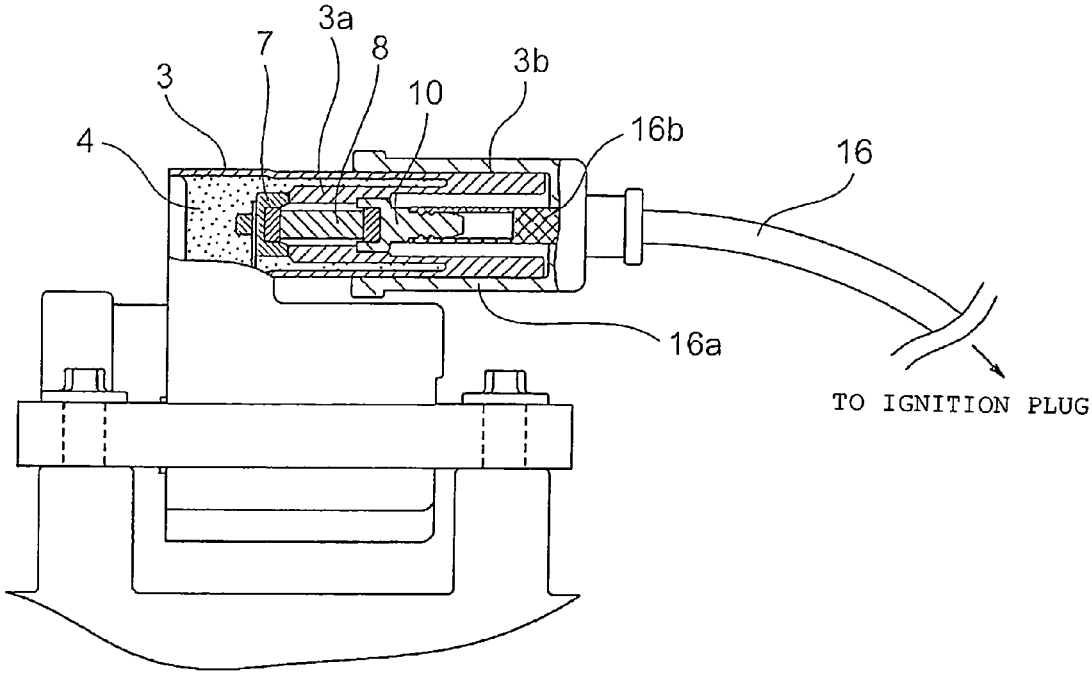
FIG. 5 is a cross-sectional view showing an essential part of an ignition device for an internal combustion engine according to a fifth embodiment of the present invention.

FIG. 5 is a cross-sectional view showing an essential part of an ignition device for an internal combustion engine according to a fifth embodiment of the present invention.

According to the examples shown in the first to fourth embodiments, the ignition device for the internal combustion engine is disposed directly on the spark plug 9. FIG. 5 shows, however, an example in which the present invention is applicable even when the ignition device for the internal combustion engine is disposed apart from the spark plug.

In this embodiment, a high-voltage cable 16 is provided instead of the plug boot 12 shown in the embodiments 1 to 4. The high-voltage cable 16 connected to the spark plug has a rubber sleeve 16*a* fittingly attached to the high-voltage tower 3*b* and a terminal 16*b* provided along a central axis of the sleeve 16*a*.

According to this embodiment, there may be a case where the high-voltage cable 16 falls off from the high-voltage tower 3*b* due to engine vibration. However, the noise-suppressing resistor 8, whose both ends are fittingly attached to the high-voltage connection terminal 7 and the high-voltage output terminal 10 respectively as in the case of the noise-suppressing resistors 8 and 8A of the first to fourth embodiments, would not fall off from the high-voltage tower 3*b*.

What is claimed is:

1. An ignition device for an internal combustion engine comprising:

a transformer that has a primary winding and a secondary winding;

a case that is composed of a case body receiving the transformer, and a high-voltage tower having an opening portion, the case body and the high-voltage tower communicating with each other through the opening portion;

a cast insulating resin that is injected into the case body and cured and thus insulates and fixes the transformer;

a high-voltage connection terminal that is connected to one end of the secondary winding, closes the opening portion such that the cast insulating resin that has not been cured is prevented from entering the high-voltage tower;

a noise-suppressing resistor that is disposed in the high-voltage tower, is electrically connected to the high-voltage connection terminal, and suppresses noise generated at a time of a discharge of an spark plug; and a high-voltage output terminal that is provided in an end portion of the noise-suppressing resistor and outputs a high voltage to the spark plug.

2. An ignition device for an internal combustion engine according to claim 1, wherein the high-voltage connection terminal is integrated with the case by insert molding.

3. An ignition device for an internal combustion engine according to claim 1, wherein the high-voltage output terminal is fittingly attached to a tip end portion of the high-voltage tower, and there is an irregular surface formed between an outer peripheral surface of the high-voltage output terminal and an inner wall surface of the high-voltage tower.

4. An ignition device for an internal combustion engine according to of claim 1, wherein the noise-suppressing resistor is composed of a columnar ceramic body and electrodes provided respectively at both ends of the body.

5. An ignition device for an internal combustion engine according to claim 1, wherein the noise-suppressing resistor is composed of a core rod, electrodes provided respectively at both ends of the core rod, and a resistor wire wound around the core rod.

6. An ignition device for an internal combustion engine according to claim 1, wherein a spring is provided between the high-voltage connection terminal and the noise-suppressing resistor, and a stress is applied to the spring in such a direction as to move the high-voltage connection terminal and the noise-suppressing resistor away from each other.

7. An ignition device for an internal combustion engine according to claim 6, wherein the high-voltage connection terminal has a shape of a cylinder with a closed bottom and an opening on a side of the noise-suppressing resistor, and an inner diameter of the high-voltage connection terminal is larger than an outer diameter of the electrodes of the noise-suppressing resistor.

* * * * *